US006470198B1

(12) United States Patent
Kintaka et al.

(10) Patent No.: US 6,470,198 B1
(45) Date of Patent: Oct. 22, 2002

(54) ELECTRONIC PART, DIELECTRIC RESONATOR, DIELECTRIC FILTER, DUPLEXER, AND COMMUNICATION DEVICE COMPRISED OF HIGH TC SUPERCONDUCTOR

(75) Inventors: Yuji Kintaka, Omihachiman; Norifumi Matsui, Kyoto, both of (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/560,086

(22) Filed: Apr. 28, 2000

(30) Foreign Application Priority Data

Apr. 28, 1999 (JP) ..... 11-122506

(51) Int. Cl.[7] ..... H01P 1/213; H01B 12/02

(52) U.S. Cl. ..... 505/210; 333/202; 333/134; 333/99.005; 333/219.1; 505/700; 505/886

(58) Field of Search ..... 333/995, 219.1, 333/202, 134; 505/210, 700, 701, 866

(56) References Cited

U.S. PATENT DOCUMENTS 5,051,397 A * 9/1991 Sato et al. ..... 505/701 X
5,215,959 A 6/1993 Van Duzer ..... 505/700 X
5,359,149 A * 10/1994 Seike et al. ..... 505/706 X

FOREIGN PATENT DOCUMENTS

EP 0720248 A2 7/1996
JP 44104 * 2/1989 ..... 333/227

OTHER PUBLICATIONS

European Search Report dated Feb. 18, 2002.

Gallopp J., "Microwave Applications Of High–Temperature Superconductors" Superconductor Science and Technology, IOP Publishing, Techno House, Bristol, GB, vol. 10, No. 7A, Jul. 1, 1997, pp. A120–A141, XP000692892.

V.B. Braginsky et al., "Superconducting Resonators On Sapphire" IEEE Transactions on Magnetics, vol. 15, No. 1., Jan. 1979, pp. 30–32, XP002188554.

* cited by examiner

*Primary Examiner*—Benny T. Lee
(74) *Attorney, Agent, or Firm*—Ostrolenk, Faber, Gerb & Soffen, LLP

(57) ABSTRACT

In a dielectric resonator, a superconductor is formed on two neighboring surfaces of a cubic dielectric body, and the superconductors formed on each two neighboring surfaces are connected by a silver electrode formed in the vicinity of the edge where the neighboring two surfaces join.

11 Claims, 5 Drawing Sheets

ELECTRONIC PART, DIELECTRIC RESONATOR, DIELECTRIC FILTER, DUPLEXER, AND COMMUNICATION DEVICE COMPRISED OF HIGH TC SUPERCONDUCTOR

BACKGROUND OF THE INVENTION

1. Field of the Invention

The present invention relates to a dielectric resonator, dielectric filter, duplexer, communication device, and electronic part with a superconductor formed therein which are usable for example in base stations for microwave- and milliwave-band communication equipment.

2. Description of the Related Art

A conventional dielectric resonator is explained with reference to FIG. 9. FIG. 9 is a perspective view of a conventional dielectric resonator.

As shown in FIG. 9, the conventional dielectric resonator 110 is composed of a dielectric body 111 in a cubic shape measuring 22 mm on each edge which is made up of a dielectric material of, for example, a Ba(Sn, Mg, Ta)$O_3$ system. A superconductor 112 is formed on the entire external surface of the dielectric body 111 by screen printing, that is, a thick superconducting film of, for example, 2223 phase of a Bi system. In the dielectric resonator 110 having such composition, the superconductor 112 formed all over the external surface of the dielectric body 111 functions as a shield electrode at a fixed temperature, and forms a resonance space. Furthermore, the unloaded Q of such a resonator 110 is about 30,000 at a frequency of 2 GHz and a temperature of 70 K.

Generally, when a superconductor is used under certain conditions, the surface resistance decreases. For example, the loss of a dielectric filter using a dielectric resonator with a superconductor formed thereon is reduced. Further, in a microstrip-line filter composed of stripline electrodes formed on a dielectric substrate by using a superconductor thin film, when the input power is increased, the loss increases due to the edge effect. According to the dielectric resonator shown in FIG. 9, the electric field is not concentrated at one point and accordingly even if the input power is increased the loss does not relatively increase.

However, there is a problem, in that the quality of the superconductor formed in the vicinity of the edge where two neighboring surfaces join deteriorates in the conventional dielectric resonator. That is, in the superconductor formed in the vicinity of the edge of the dielectric resonator, the surface resistance increases, and because of this effect of the superconductor formed in the vicinity of the edge, a desired Q at no load is cannot be realized upon an increase of the input power, and so on.

Furthermore, in order to find causes of this problem, a study has been done by the inventors. It has been found that the surface resistance of the superconductor is greatly affected by the morphology (geometrical factors such as the size and shape of crystal grains, arrangement of crystal grains, etc.), and it is easy to realize conditions which reduce the surface resistance of the superconductor formed on a flat area, but it is difficult to reduce the surface resistance of the superconductor formed in the vicinity of the edge. Therefore, in the conventional dielectric resonator, the surface resistance of the superconductor formed in the vicinity of the edge increases, and as a result it is difficult to increase the unloaded Q of the dielectric resonator.

Further, generally the mechanical strength of superconductors is low, and another problem is that the superconductor formed in the vicinity of the edge of the dielectric resonators peels off or chips off and the reliability is decreased.

SUMMARY OF THE INVENTION

The present invention of an electronic part, dielectric resonator, dielectric filter, duplexer, and communication device was made in consideration of the above-mentioned problems, and it is an object of this invention to present an electronic part, dielectric resonator, dielectric filter, duplexer, and communication device in which the problems are solved, the unloaded Q is increased by suppressing the increase of the surface resistance in the vicinity of the edge, and, further, the reliability of the electrode formed in the vicinity of the edge is increased.

In order to attain the above object, an electronic part according to a first aspect of the present invention comprises a dielectric body in a polyhedral shape, a superconductor formed on at least two neighboring surfaces of the dielectric body, and a metal electrode formed in the vicinity of the edge where the neighboring two surfaces join. The superconductors formed on the neighboring two surfaces are connected by the metal electrode.

Further, a dielectric resonator according to a second aspect of the present invention comprises a dielectric body in a polyhedral shape, a structure in the dielectric body providing a resonance characteristic, a superconductor formed on at least two neighboring surfaces of the dielectric body, and a metal electrode formed in the vicinity of the edge where the neighboring two surfaces join. The superconductors formed on the neighboring two surfaces are connected by the metal electrode.

When the superconductors formed on the neighboring two surfaces of the polyhedral dielectric resonator are connected by the metal electrode formed in the vicinity of the edge where the neighboring surfaces join, the surface resistance in the vicinity of the edge is made lower than the case where the edge is formed by only the superconductors. That is, unlike in a superconductor, in a metal electrode it is considered that the morphology has only a little influence on the surface resistance, even around the edge. Therefore, an electrode having a relatively low surface resistance can be obtained. Further, a metal electrode is higher in mechanical strength and strength of bonding to the dielectric body than a superconductor. Therefore, the reliability of the dielectric body can be improved by preventing peeling off or chipping off of the electrode in the vicinity of the edge in handling the dielectric resonator.

Further, in a dielectric resonator according to a third aspect of the present invention, the superconductor is formed on the entire surface of a polyhedron of a dielectric body. A resonance space is formed by the superconductor formed on the whole surface of the polyhedron and a stable resonance characteristic can be obtained.

Further, in a dielectric resonator according to a fourth aspect of the present invention, the metal electrode is made up of silver or an alloy of silver as a main component. Silver or an alloy of silver as a main component has better bonding characteristics than other metal electrode materials, and further it does not cause any deterioration of the unloaded Q of the dielectric resonator when it is used in the vicinity of the edge.

Further, in a dielectric filter according to a fifth aspect of the present invention, a dielectric resonator according to any one of the second through fourth aspects of the present invention has, in addition, input-output connectors.

Further, a duplexer according to a sixth aspect of the present invention has at least two dielectric filters, input-output connectors connected to each of the dielectric filters, and an antenna connector commonly connected to both of the dielectric filters. At least one of the dielectric filters is a dielectric filter according to the fifth aspect of the present invention.

Further, a communication device according to a seventh aspect of the present invention has a duplexer according to the sixth aspect of the present invention, a transmission circuit connected to at least one of the input-output connectors of the duplexer, and a reception circuit connected to at least one of the input-output connectors which is different from the input-output connector connected to the transmission circuit. An antenna may be connected to the antenna connector of the duplexer.

In this way, a dielectric filter, duplexer, and communication device having low losses are obtained by using a dielectric resonator having a high unloaded Q.

Other features and advantages of the invention will be appreciated from the following detailed description, with reference to the drawings, in which like references in the various figures indicate like elements and parts, and redundant description of like elements and parts is omitted.

DESCRIPTION OF EMBODIMENTS OF THE INVENTION

Figure 1:
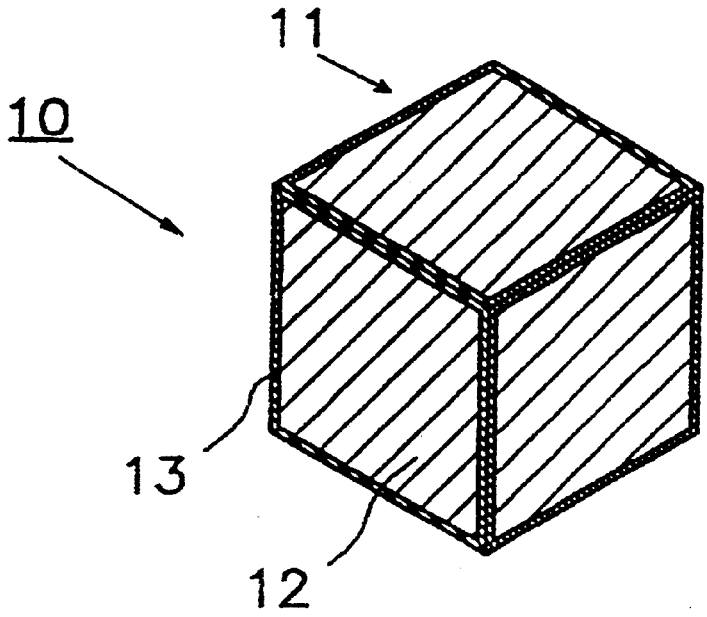
FIG. 1 is a perspective view of a dielectric resonator of a first embodiment of the present invention.

Hereinafter, a dielectric resonator of an embodiment of the present invention is explained with reference to FIG. 1. FIG. 1 is a perspective view of a dielectric resonator of the present invention.

As shown in FIG. 1, the dielectric resonator 10 of the present embodiment is composed of a dielectric body 11 in a cubic shape, a superconductor 12 formed on all the external surface of the dielectric body 11, and a metal electrode 13 formed around all the edges. The dielectric body 11 is formed by molding and firing a dielectric body of, for example, a Ba(Sn, Mg, Ta)$O_3$ system, and is in this example 22 cm on an edge. Further, as for the superconductor 12, a thick superconducting film of 2223 phase in a Bi system is formed by screen printing so as to be nearly 10 $\mu$m in thickness. Further, regarding the metal electrode a thick film of silver is formed by screen printing to be nearly 10 $\mu$m in thickness. In the dielectric resonator 10 having such a construction, the superconductor 12 formed on all the external surface of the dielectric body 11 functions as a shield electrode at a fixed temperature, and forms a resonance space.

Figure 9:
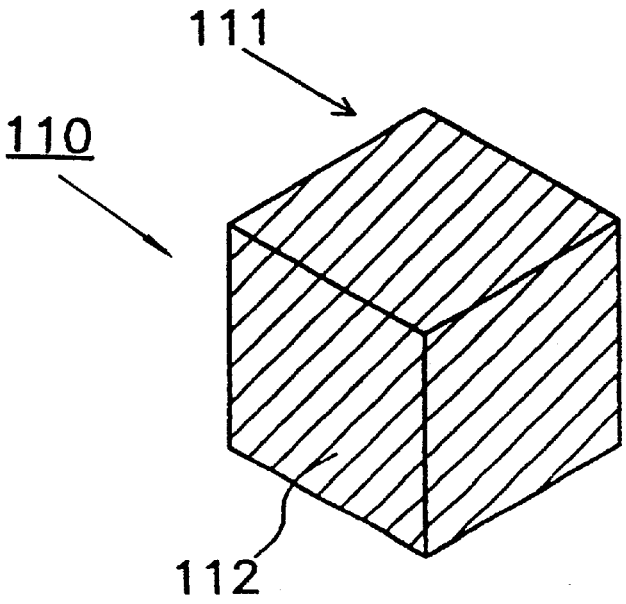
FIG. 9 PRIOR ART
FIG. 9 is a perspective view of a conventional dielectric resonator.

In the conventional dielectric resonator 110 of FIG. 9, because the edge portion was made up of a superconductor the surface resistance in that area has been increased. In contrast, in the present embodiment, a metal electrode 13 of silver is formed around the edges of the dielectric resonator 10. Therefore, the superconductors 12 formed on the neighboring two surfaces sandwiching each edge are fully connected, which thereby avoids the loss caused by increased surface resistance around the edge.

The dielectric resonator 10 of the present embodiment is effective for use with high input power as in communication base stations, etc., in particular. That is, although the loss of the superconductor 12 tends to increase when the input power increases, in the dielectric resonator of the present embodiment the metal electrode formed around the edge causes the loss to be lower, even if the input power increases, and as a whole the improvement of unloaded Q can be aimed at. In the dielectric resonator 10 of the present embodiment the unloaded Q is about 40,000 under the conditions of 2 GHz and 70 K, and is improved over the conventional dielectric resonator 110.

The metal electrode 13 made up of silver is high in mechanical strength and strength of bonding to the dielectric body. Therefore, in handling the dielectric resonator 10, the electrode formed around the edge does not peel off, nor does the electrode chip off, and the reliability of the dielectric resonator 10 is improved.

Furthermore, in the present embodiment, a dielectric body of a Ba(Sn, Mg, Ta)$O_3$ system was used as the dielectric body 11, a thick superconducting film of 2223 phase of a Bi system was used as the superconductor 12, and silver was used as the metal electrode, but the present invention is not limited to these. That is, a dielectric body of MgO system, Sr(Mg, Ta)$O_3$ system, Ba(Zn, Ta)$O_3$ system, $LaAlO_3$ system, etc. may be used as the dielectric body 11, and a thick superconducting film of 2212 phase of Bi system, Y system, T1 system, etc. may be used as the superconductor 12. An alloy of silver as a main component, copper, etc. may be used as the metal electrode 13.

Further, the edge portion of the present embodiment has an angle of approximately 90° between each two neighboring surfaces, but, for example, even an edge portion which is chamfered or forms any arbitrary dihedral angle or has a curved corner of any arbitrary radius R can benefit from the effect of the present invention. The principles of the invention can also be applied to the following embodiments.

Figure 2:
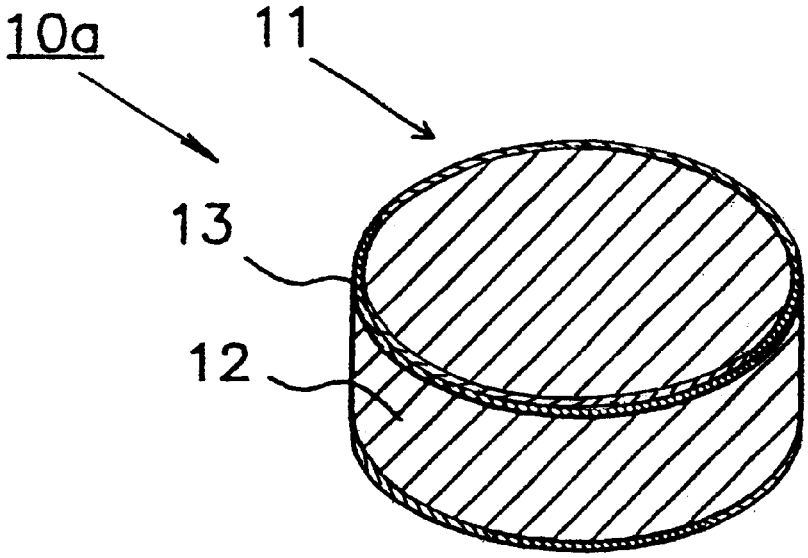
FIG. 2 is a perspective view of a dielectric resonator of a second embodiment of the present invention.

Next, a dielectric resonator of a second embodiment of the present invention is explained with reference to FIG. 2. FIG. 2 is a perspective view of a dielectric resonator of the present invention.

As shown in FIG. 2, the dielectric resonator 10*a* of the present embodiment is composed of a dielectric body 11 of Ba(Sn, Mg, Ta)$O_3$ system, a superconductor 12 of a thick superconducting film of 2223 phase of Bi system formed on all the external surface of the dielectric body 11, and a metal electrode 13 of silver formed around the edge. The dielectric body 11 is in a cylindrical shape which is 23 mm in diameter and 10 mm in height, and here the edge portions are defined to be the boundary portion between the upper surface and the surrounding side surface and the boundary portion between the lower surface and the surrounding side surface. In the dielectric resonator 10*a* of such a composition, unloaded Q is nearly 30,000 under the conditions of 2 GHz and 70 K, which is about the same as in the dielectric resonator 110 shown in FIG. 9. However, the dielectric resonator 10*a* of the present embodiment has the advantage that a smaller dielectric resonator can be obtained while attaining the same unloaded Q as in the conventional dielectric resonator 110, and has the further advantage of greater mechanical reliability.

Figure 3:
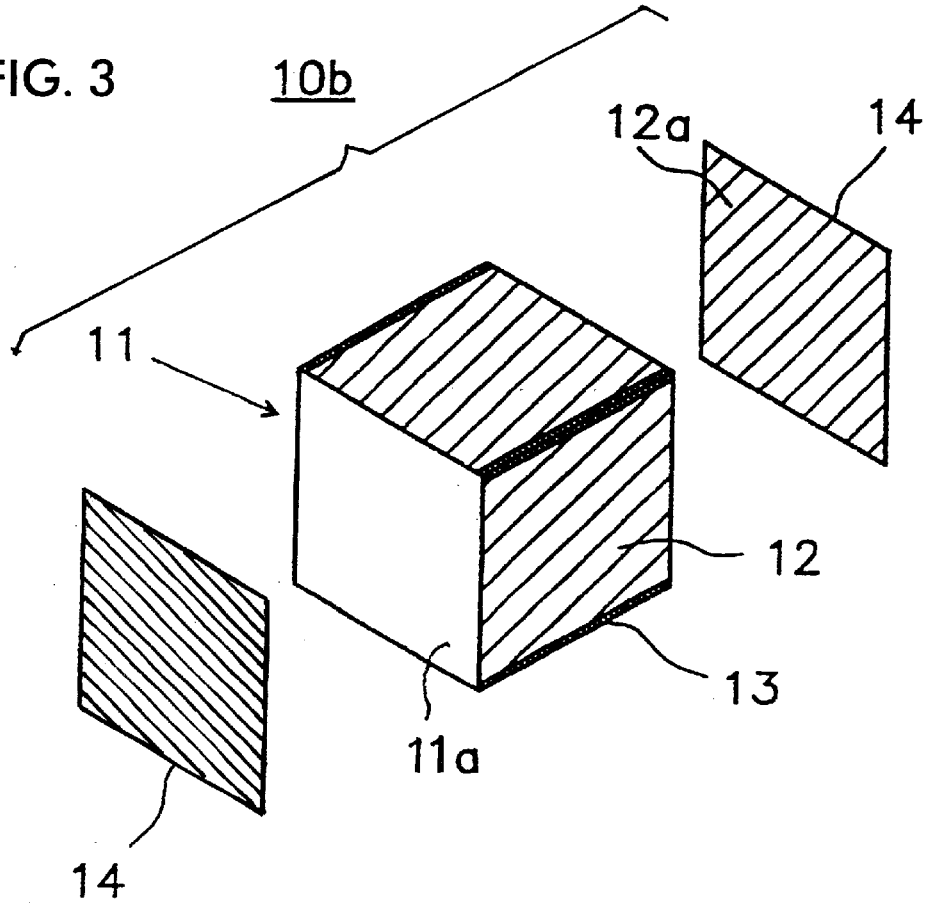
FIG. 3 is an exploded perspective view of a dielectric resonator of a third embodiment of the present invention.

Further, a dielectric resonator of a third embodiment of the present invention is explained with reference to FIG. 3. FIG. 3 is an exploded perspective view of a dielectric resonator of a third embodiment.

As shown in FIG. 3, in the dielectric resonator 10*b* of the present embodiment, except on two opposing surfaces 11*a* of a dielectric body 11 of MgO system in a cubic shape 34 mm on an edge, a superconductor 12 made up of a thick superconducting film of 2212 phase of Bi system is formed by screen printing. Around the edges where the surfaces of the superconductor 12 intersect a metal electrode 13 of silver is formed by screen printing.

Further, in the present embodiment, a superconductor 12*a* of a thick superconducting film of 2212 phase of Bi system is formed on a silver substrate 14 of 0.3 mm in thickness. This silver substrate 14 is adhered by polyimide resin on the two surfaces 11*a* where superconductors are not formed so that the superconductor 12*a* is adhered to the surface 11*a* of the dielectric body. Each silver substrate is extended around the adjacent edges of the dielectric body 11 and onto the neighboring superconductor surfaces 12. In this way, the entire external surface of the dielectric body 11 is shielded by the superconductor 12, and the dielectric resonator 10*b* with a resonance space is formed.

In order to improve the characteristics such as unloaded Q, etc., in the dielectric resonator 10*b,* it is not desirable for the surface with the silver substrate 14 thereon to be a surface which is normal to the electric field of the resonance mode to be used. That is, assume that the present embodiment of FIG. 3 will utilize the $TM_{110}$ mode where the electric field is in the up-and-down direction as seen in FIG. 3, and the $TE_{101}$ mode where the electric field is in the direction from the upper-left side to the lower-right side as seen in FIG. 3. In such a case, it is desirable for the silver substrate 14 to be placed only on the lower-left side surface and the upper-right side surface as seen in FIG. 3.

A superconductor shows different characteristics such as surface resistance, etc. dependent on the substrate on which the superconductor is formed. Therefore, when a superconductor is formed, if the superconductor is formed on an optimal substrate chosen, there are advantages of decreased surface resistance, and so on. Thus, as in the present embodiment, when the superconductor 12 is not formed directly on the dielectric body 11, but rather on another optimal substrate, that is, a silver substrate 14, a dielectric resonator having a high Q at no load can be obtained compared with the case where the superconductor 12 is directly formed on the dielectric body 11. In the dielectric resonator 10*b* of the present embodiment, unloaded Q is nearly 70,000 under the conditions of 2 GHz and 70 K.

In the present embodiment of FIG. 3, because the two resonance modes have corresponding electric field meeting at right angles, the silver substrates 14 are adhered to only two opposing surfaces, in consideration of the characteristics of the dielectric resonator. However, in a case in which only one resonance mode is used the silver substrate 14 can be placed on four surfaces, since there are only two surfaces normal to the corresponding electric field.

Figure 4:
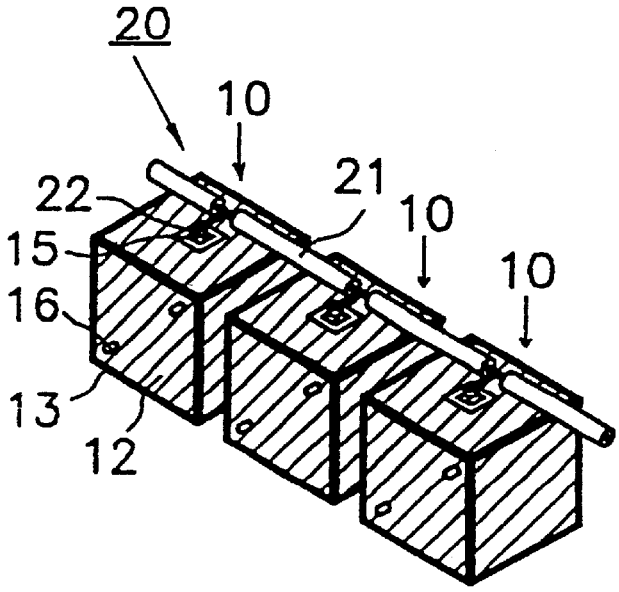
FIG. 4 is a perspective view of a dielectric filter of a fourth embodiment of the present invention.

Next, a dielectric filter of a fourth embodiment of the present invention is explained with reference to FIG. 4. FIG. 4 is a perspective view of a dielectric filter of the present embodiment. Further, as the dielectric resonator has the same construction as that in the first embodiment, the explanation is omitted.

As shown in FIG. 4, the dielectric filter 20 of the present embodiment is constructed in such a way that three of the dielectric resonators 10 are placed in series and they are connected by a coaxial line 21 having a length between each two adjacent resonators of $\lambda/4$ when the wavelength of the frequency to be used is represented by $\lambda$. An input-output electrode 15 is formed in the middle of the upper surface of each dielectric resonator 10 by removing the superconductor in a ring shape. Each input/output electrode 15 is connected to the coaxial line 21 by a coupling capacitor 22. The coupling capacitor 22 may be of the type wherein a pair of opposing electrodes are formed on opposite sides of a dielectric material. Each input-output electrode 15 is connected to one electrode of a corresponding coupling capacitor 22 by soldering, etc., a copper leaf (not illustrated) which is bent in an arc shape. The other electrode of each coupling capacitor 22 is connected to the coaxial line 21.

As constructed this way, a signal of a fixed frequency input from the outside is coupled with the $TM_{110}$ mode where the electric field exists in the up-and-down direction of the dielectric resonator 10, and further the $TM_{110}$ mode is coupled with the $TE_{101}$ mode where the electric field exists in the direction from the upper-left side to the lower-right side (as seen in FIG. 4) through a coupling hole 16 formed in the dielectric resonator 10. Therefore, one dielectric resonator 10 functions as two stages of a band-stop filter, and since three of the dielectric resonators 10 are connected in series, the dielectric filter 20 functions as a six stage band-stop filter in total.

Figure 5:
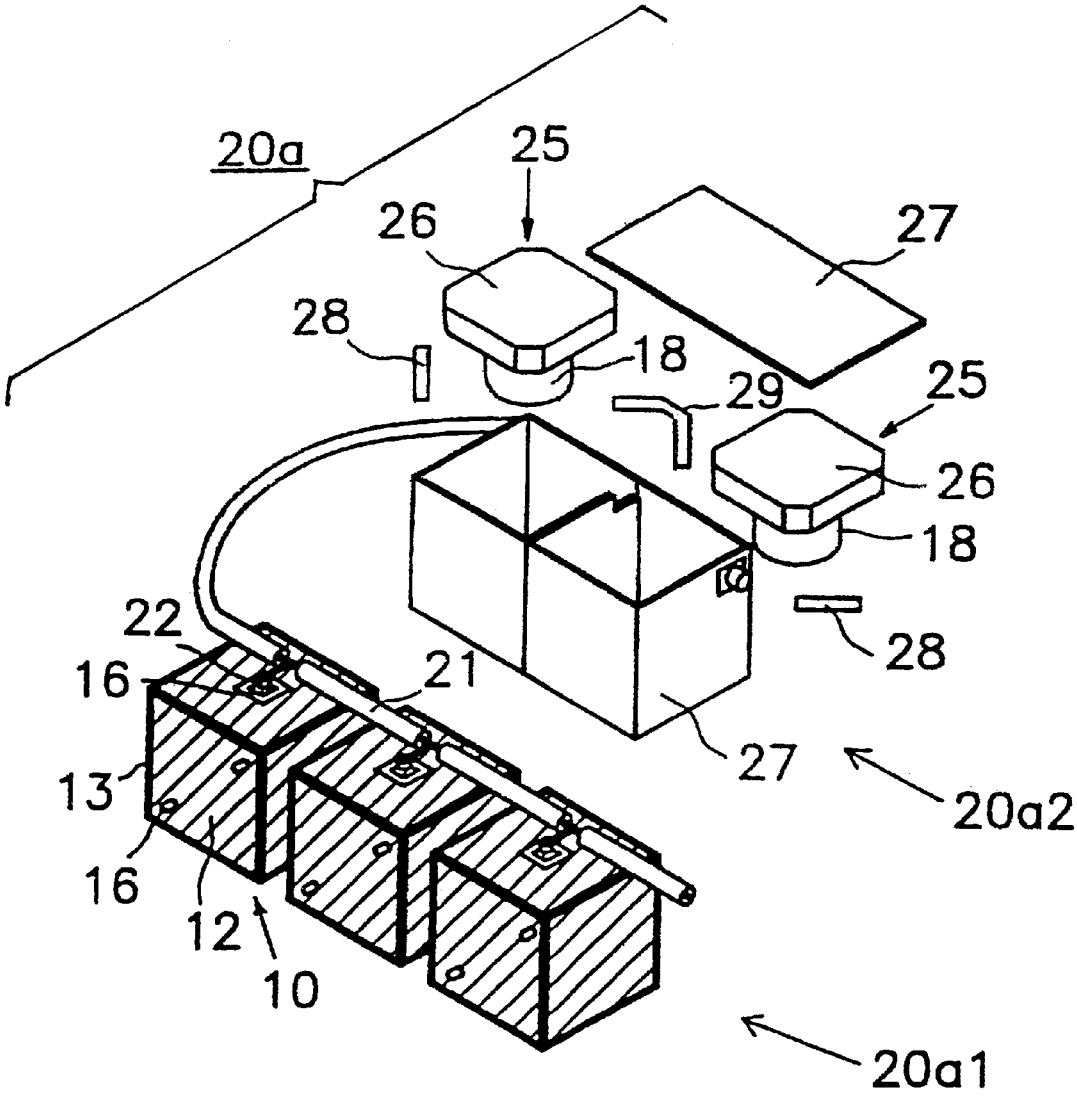
FIG. 5 is an exploded perspective view of a dielectric filter of a fifth embodiment of the present invention.

Further, a dielectric filter of a fifth embodiment of the present invention is explained with reference to FIG. 5. FIG. 5 is an exploded perspective view of a dielectric filter of the present embodiment. Further, as the band-stop filters are the same as in the previous embodiment, their explanation is omitted.

As shown in FIG. 5, the dielectric filter 20*a* of the present embodiment is composed in part of a band-stop filter 20*a*1 and in part of a bandpass filter 20*a*2. The bandpass filter 20*a*2 is composed of two dielectric resonators 25 placed in parallel, and each of the dielectric resonators 25 is constructed by arranging a dielectric body 26 in a flat shape mounted on a support 18 in a sealed case 27. Regarding the dielectric resonator 25 having such a construction, each of the resonators 25 functions as a triple-mode resonator having three resonance modes and therefore, the bandpass filter 20*a*2 functions as a six stage bandpass filter in total, having a pair of input-output loops 28, and a coupling loop 29 between the two resonators.

By combining the band-stop filter 20*a*1 and the bandpass filter 20*a*2, the dielectric filter 20*a* functions as a bandpass filter as a whole and by combining both of these characteristics it becomes possible to realize steep filtering characteristics.

Figure 6:
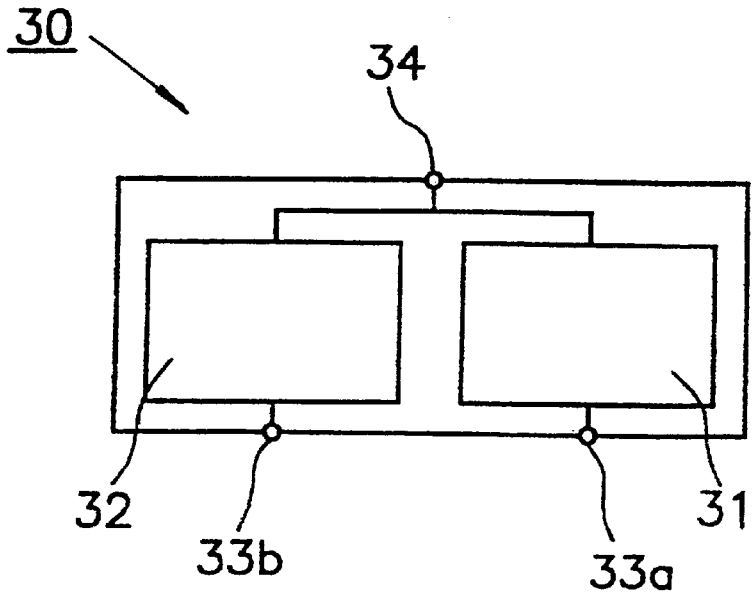
FIG. 6 is a schematic illustration of a duplexer of a sixth embodiment of the present invention.

Further, a duplexer of a sixth embodiment of the present invention is explained with reference to FIG. 6. FIG. 6 is a schematic illustration of a duplexer of the present embodiment.

As shown in FIG. 6, the duplexer 30 of the present embodiment is composed of a transmission filter 31 and reception filter 32, and input-output connecting terminals 33*a* and 33*b* are formed on the input side of the transmission filter 31 and output side of the reception filter 32. Further, the output side of the transmission filter 31 and input side of the reception filter 32 are combined at an antenna connecting terminal 34. The transmission filter 31 and reception filter 32 in this duplexer 30 are the dielectric filter 20*a* of the fifth embodiment shown in FIG. 5. Only a signal in one fixed frequency band passes through the transmission filter 31, and only a signal in c band passes through the reception filter 32.

Figure 7:
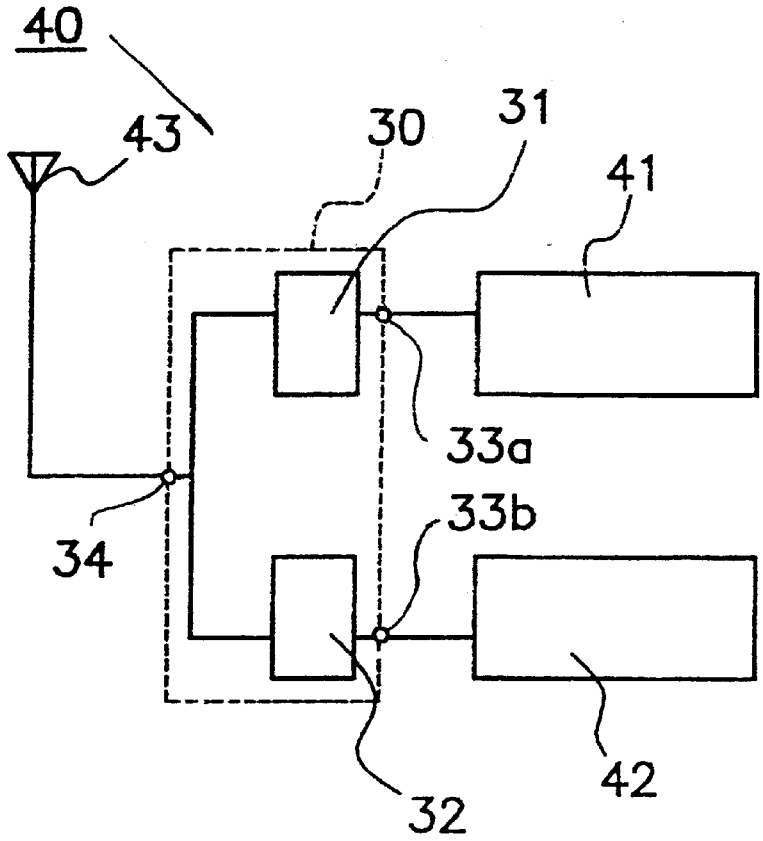
FIG. 7 is a schematic illustration of a communication device of a seventh embodiment of the present invention.

Further, a communication device of a seventh embodiment of the present invention is explained with reference to FIG. 7. FIG. 7 is a schematic illustration of a communication device of the present embodiment.

As shown in FIG. 7, the communication device 40 of the present embodiment is composed of a duplexer 30, a transmission circuit 41, a reception circuit 42, and an antenna 43. Here, the duplexer 30 is what is shown in the previous embodiment of FIG. 6, the input-output connecting terminal 33*a* connected to the transmission circuit 31 in FIG. 6 is connected to the transmission circuit 41, and the input-output connecting terminal 33*b* connected to the reception circuit 32 in FIG. 6 is connected to the reception circuit-42. Further, the, antenna connecting terminal 34 is connected to the antenna 43.

Figure 8:
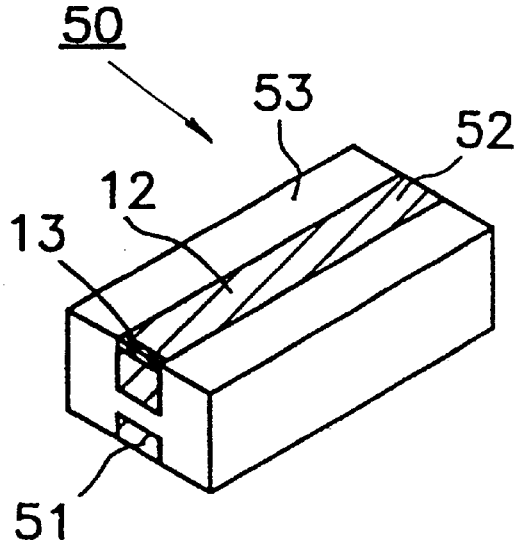
FIG. 8 is a perspective view showing an example where the present invention is applied to a dielectric chip antenna.

As described above, the present invention is applied to dielectric resonators, but the application of the present invention is not limited to dielectric resonators. That is, for example, as shown in FIG. 8, the present invention can be applied to a dielectric chip antenna 50 having a feed electrode 51 and radiation electrode 52 and a superconductor 12 is formed so as to extend over two neighboring surfaces of a dielectric body 53 having the form of a rectangular solid.

Further, the resonator embodiments of FIGS. 1–3 can be freely combined and substituted for each other in the multistage filters and duplexer of FIGS. 4–6.

As described above, according to the present invention, two neighboring surfaces of a polyhedral dielectric body have superconductors formed thereon, and a metal electrode is formed around the edge where the two neighboring surfaces join, for connecting the superconductors formed on the two surfaces. In this way, the increase of the loss caused by the increased surface resistance around the edge is prevented, and unloaded Q is improved as a whole. Further, such an effect becomes noticeable when the input power increases, silver is used as the metal electrode, and so on, as described above.

While the invention has been particularly shown and described with reference to embodiments thereof, it will be understood by those skilled in the art that the foregoing and other changes in form and details can be made without departing from the spirit and scope of the invention.

What is claimed is:

1. An electronic part comprising:

a dielectric block in a polyhedral shape, a superconductor disposed on at least two neighboring outer surfaces of the dielectric block, and a metal electrode disposed in the vicinity of the edge where the neighboring two outer surfaces join, wherein the superconductors on the neighboring two outer surfaces are connected by the metal electrode.

2. A dielectric resonator comprising:

a dielectric block in a polyhedral shape, wherein the dielectric block has a structure which provides a resonance characteristic, a superconductor disposed on at least two neighboring outer surfaces of the dielectric block, and a metal electrode disposed across an edge where the neighboring two outer surfaces join, wherein the superconductors on the neighboring two outer surfaces are connected by the metal electrode.

3. A dielectric resonator as claimed in claim 2, wherein the metal electrode is comprised of silver or an alloy of silver as a main component thereof.

4. A dielectric resonator as claimed in claim 2, wherein the superconductor is disposed on substantially the entire surface of the dielectric block.

5. A dielectric resonator as claimed in claim 4, wherein the metal electrode is comprised of silver or an alloy of silver as a main component thereof.

6. A dielectric resonator as claimed in claim 2, wherein on a portion of the dielectric body, the superconductor is disposed on a metal substrate and the metal substrate is adhered to the dielectric block.

7. A dielectric resonator as claimed in claim 6, wherein the metal electrode and metal substrate are comprised of silver or an alloy of silver as a main component thereof.

8. A dielectric filter comprising:

a dielectric block in a polyhedral shape, wherein the dielectric block has a structure which provides a resonance characteristic, a superconductor disposed on at least two neighboring outer surfaces of the dielectric block, and a metal electrode disposed across an edge where the neighboring two outer surfaces join, wherein the superconductors on the neighboring two outer surfaces are connected by the metal electrode; and an input-output connector disposed on said dielectric block for coupling an electromagnetic field into and out of said dielectric block.

9. A duplexer comprising at least two dielectric filters, each of the dielectric filters having a pair of input-output connectors, and an antenna connector commonly connected to a respective input-output connector of a corresponding one of the dielectric filters, wherein at least one of the dielectric filters comprises a respective dielectric block in a polyhedral shape, wherein the dielectric block has a structure which provides a resonance characteristic, a respective superconductor disposed on at least two neighboring outer surfaces of the corresponding dielectric block, and a respective metal electrode disposed across an edge where the neighboring two outer surfaces join, wherein the respective superconductors on the neighboring two outer surfaces are connected by the corresponding metal electrode; and wherein the respective pair of input-output connectors of said at least one of the dielectric filters are disposed on said corresponding dielectric block for coupling an electromagnetic field into and out of said dielectric block.

10. A communication device comprising a duplexer as claimed in claim 9, a transmission circuit connected to one of the pair of input-output connectors of the duplexer, a reception circuit connected to another one of the pair of input-output connectors, and an antenna connected to the antenna connector of the duplexer.

11. A communication device comprising:

a dielectric filter comprising a dielectric block in a polyhedral shape, wherein the dielectric block has a structure which provides a resonance characteristic, a superconductor disposed on at least two neighboring outer surfaces of the dielectric block, and a metal electrode disposed across an edge where the neighboring two outer surfaces join, the superconductors on the neighboring two outer surfaces being connected by the metal electrode, an input-output connector being disposed on said dielectric block for coupling an electromagnetic field into and out of said dielectric block; and a high frequency circuit comprising at least one of a transmission circuit and a reception circuit, said input-output connector being connected to said high frequency circuit.

* * * * *